US005131831A

United States Patent [19]

Peeters

[11] Patent Number: 5,131,831

[45] Date of Patent: Jul. 21, 1992

[54] DEVICE FOR PRESSING A SUPPLY OF CLAY TO INDIVIDUAL MOULDINGS TO BE DEPOSITED IN A MOULDING TRAY

[75] Inventor: Rudy Peeters, Scharnegoutum, Netherlands

[73] Assignee: Beheermaatschappij De Boer Nijmegen B.V., Nijmegen, Netherlands

[21] Appl. No.: 635,125

[22] Filed: Mar. 8, 1991

[30] Foreign Application Priority Data

Jul. 10, 1989 [NL] Netherlands ..... 8901771

[51] Int. Cl.[5] ..... B28B 13/02

[52] U.S. Cl. ..... 425/257; 425/258; 425/259; 425/261; 425/447; 425/449

[58] Field of Search ..... 425/256, 257, 258, 259, 425/261, 297, 305.1, 315, 394, 397, 447, 449

[56] References Cited

U.S. PATENT DOCUMENTS

| | | | |
|---|---|---|---|
| 457,381 | 8/1891 | Sims | 425/259 |
| 2,389,163 | 11/1945 | Miller et al. | 425/449 |
| 2,494,112 | 1/1950 | Wahl | 425/259 |
| 4,065,238 | 12/1977 | Sinnema | 425/297 |
| 4,708,621 | 11/1987 | Schmidgall et al. | 425/259 |

FOREIGN PATENT DOCUMENTS

| | | | |
|---|---|---|---|
| 2128666 | 12/1972 | Fed. Rep. of Germany | 425/261 |
| 8802564 | 5/1990 | Netherlands . | |
| 8802565 | 5/1990 | Netherlands . | |
| 8802566 | 5/1990 | Netherlands . | |
| 8802567 | 5/1990 | Netherlands . | |
| 8802568 | 5/1990 | Netherlands . | |

*Primary Examiner*—Jay H. Woo
*Assistant Examiner*—James P. Mackey
*Attorney, Agent, or Firm*—Bauer & Schaffer

[57] ABSTRACT

A frame is swingably mounted to a stationary support above an indexing mold tray conveyor. Mounted to the frame is a clay supply device comprising an extruder and a pair of mutually facing belts having vertical runs. Lumps of clay are extruded and deposited by the facing belts in the tray cavities on the tray conveyor.

6 Claims, 2 Drawing Sheets

Figure 1:
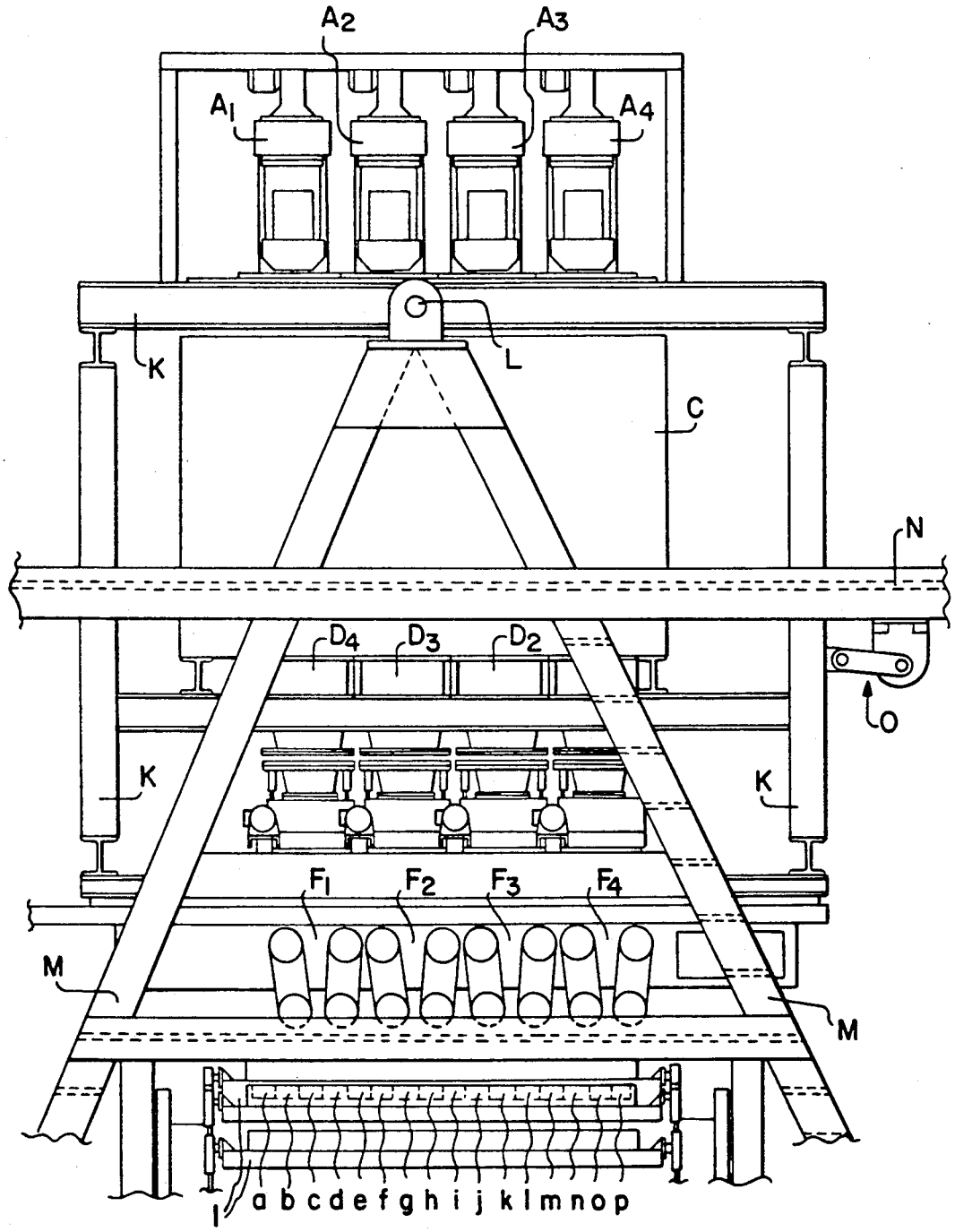

DEVICE FOR PRESSING A SUPPLY OF CLAY TO INDIVIDUAL MOULDINGS TO BE DEPOSITED IN A MOULDING TRAY

BACKGROUND OF THE INVENTION

The present invention relates to clay moulding apparatus and in particular to apparatus for supplying clay lumps to successive mould trays.

In particular a supply of clay is formed into individual lumps and deposited side-by-side into mould cavities of a tray conveyor. The apparatus has at least one extruder and the lumps are deposited by two cooperating, substantially vertically positioned conveyor belts located beneath the nozzle of the extruder.

Clay moulding apparatus is disclosed in NL-A-161832 and improved embodiments of the same are disclosed in prior Dutch patent applications 8802565 to 8802567. Apparatus of this type are particularly suitable for forming mouldings for bricks having the characteristic "hand mould structure".

In general large numbers of moulding trays are involved, which are intermittently supplied to a loading station. Each station contains a large number, e.g. sixteen juxtaposed mould cavities. Usually the extruder comprises a number of presses with associated nozzles and depositing means, which number corresponds to half the number of the mould cavities in each moulding tray.

For example, the supply device for loading moulding trays containing sixteen juxtaposed moulding cavities comprises two rows of four extruders. Each row extending transversly to the direction in which the moulding trays are supplied. The extruders of one row are positioned laterally offset with respect to the extruder in the other row by a distance which corresponds to the pitch of the mould cavities. The extruders in each row are mutually spaced by a distance corresponding to twice the pitch of the mould cavities in the moulding tray. Each extruder is intended to load—one immediately after the other—two juxtaposed mould cavities of each moulding tray supplied. For this purpose the respective extruder and moulding tray must, after the first of said two juxtaposed moulding cavities are loaded, be displaced longitudinally relative to one another through a distance corresponding to the pitch of the mould cavities.

In the well-known systems, the extruding device usually has a stationary position and the moulding trays—after having received a first loading—are shifted in their longitudinal direction relative to the extruding device in order to receive the load for the second moulding cavity. A disadvantage of such a system is that the reciprocating movement of the moulding trays is produced over guideways which are usually covered with sand. As a result, the molding trays undergo a rapid abrasion which necessitates frequent changing of moulding trays. As an alternative it has been proposed to keep the moulding trays stationary, within the filling station, and to reciprocate the extruding device over a guide means, in the longitudinal direction of the moulding trays through a distance corresponding to the pitch of the mould cavities. This means that each time the extruding device is moved a very heavy mass has to be accelerated and decelerated along a very short distance.

SUMMARY OF THE PRESENT INVENTION

According to the present invention an improved alternative is proposed, which is characterized in that the extruding device is mounted to a frame which is swingably suspended about an upper horizontal axis to a fixed supporting structure. Drive means is provided to impart the swinging motion about a mid position in such a way that during each swinging period two successive lumps may be simultaneously deposited into two juxtaposed cavities of a stationary moulding tray. While relatively heavy masses are involved here, they are rocked through a very small angle and such a rocking or swinging movement can be controlled far better than a rectilinearly reciprocating movement.

In a practical embodiment the drive means comprises an eccentric connecting rod mechanism mounted to the swingable frame and to the stationary supporting structure respectively. BRIEF DESCRIPTION OF THE DRAWINGS The invention will be hereinafter further described by way of example and reference to the drawings.

Figure 2:
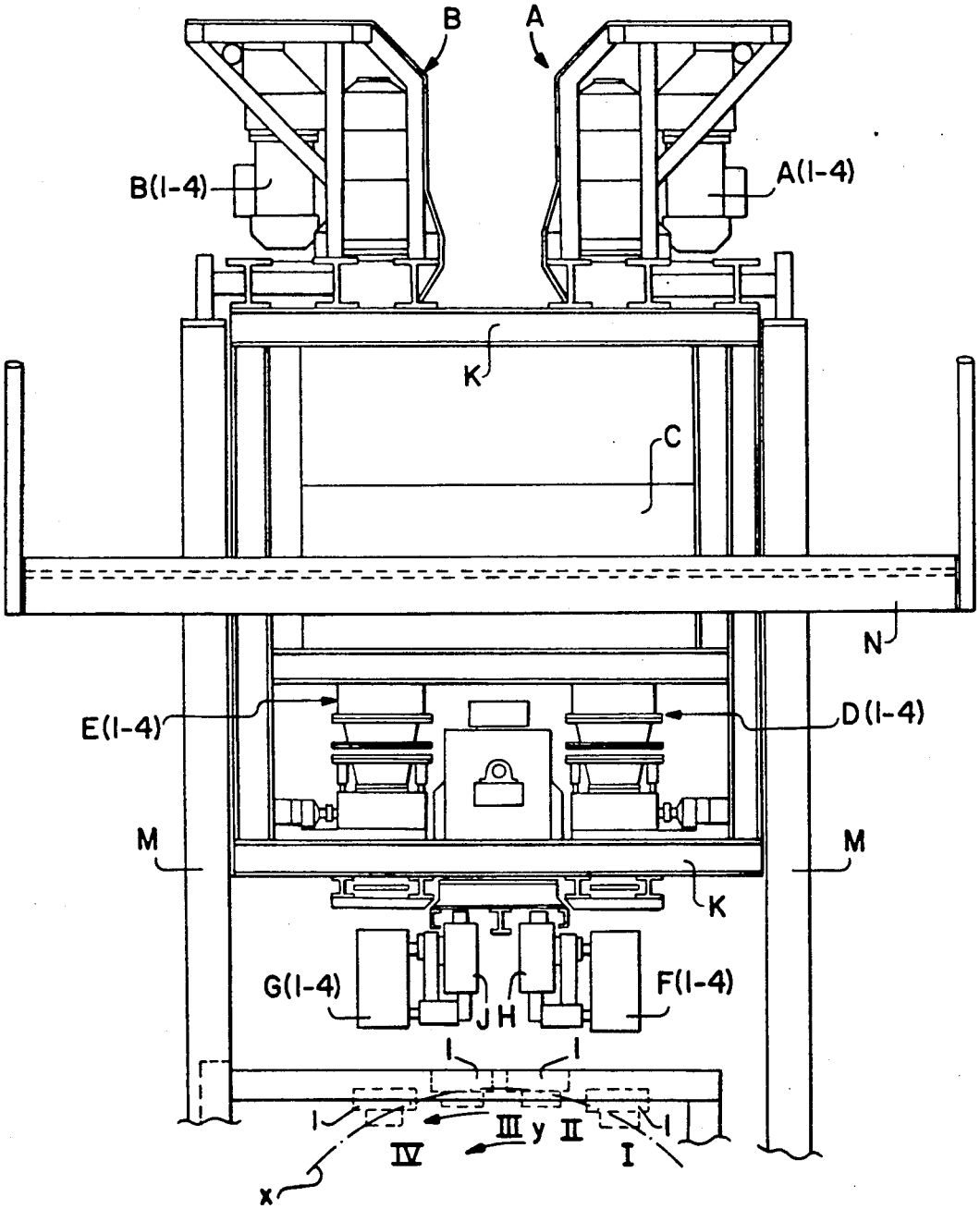

FIG. 1 is an elevational view of the apparatus according to the present invention as seen in the conveying direction of the moulding trays to be loaded and FIG. 2 is a side view of the device of FIG. 1.

DESCRIPTION OF THE INVENTION

In the drawing the moulding trays to be loaded with lumps of clay are indicated at 1. In the example shown the moulding trays each contain sixteen mould cavities a through p. In the drawing only the alternate one of the mold cavities are labeled as seen from the left to the right in FIG. 1 to avoid confusion.

As seen in FIG. 2, the moulding trays and their supports are mounted (about a longitudinal axis) between the end walls of a conveyor drum which is journaled for rotation about a parallel horizontal axis. The upper arc of the path of rotation of the conveyor drum is indicated by the dot-dash line in FIG. 2. The center of the arc X extends longitudinally perpendicular to the plane of the paper on which FIG. 2 is drawn.

As seen in FIG. 2 four moulding trays 1 are shown each located at one of four successive positions or stations, I, II, II, IV to which the conveyor drum comes to a standstill after being indexed stepwise in the direction of the arrow Y. As will appear hereinafter, the loading with lumps of clay takes place at the stations I and IV.

The extruder shown comprises two rows A and B of four presses each, the drive motors of which are indicated at A1 to A4 and B1 to B4, respectively. Feed hoppers C to which the clay is supplied and worked into lumps is located below each press. Below the hoppers C are eight extruding nozzle units D1-D4 and E1-E4 respectively. Under each of the eight extruding nozzle units there is provided transfer means F1-F4 and G1-G4 respectively depositing the lumps into the cavities. Each of the transfer means consists of two vertically arranged endless conveyor belts, which are driven with their opposing runs moving downwardly by drive means indicated at H and J respectively in FIG. 2.

As shown in FIG. 1, the four depositing belts F1 to F4 are positioned vertically over a moulding tray within station I, while the depositing belts G1 to G4 are located vertically over the moulding tray within station IV.

The entire extruding device, comprising the individual presses A and B with the respective drive means A1 to A4 and B1 to B4, the clay hoppers C, the extruding nozzles D1 to D4 and E1 to E4, as well as the conveyor belts F1 to F4 and G1 to G4 with their respective drive means are all mounted within a frame K which is swingably suspended, about a horizontal axis L, between lateral supports M of a stationary supporting structure, of which a gangway N is also a part.

FIG. 1 shows the swingable frame with the extruding device in a mid position. This mid position corresponds with the mid position of the eccentric-connecting rod mechanism, indicated at 0 by means of which the movable frame may be made to carry out a complete swinging motion each time the conveyor drum and the moulding trays carried thereby, are in a period of standstill.

In the mid position the mouths of the conveyor belts F1 to F4 are located over the partitions between the paired mould cavities c and d or, g and h or, k and l, or o and p respectively. The depositing belts G1 to G4 which are located behind the plane of drawing of FIG. 1 are (in the mid position under consideration) located respectively over the partitions between the paired mould cavities a and b or e and f or i and j or m and n respectively.

Consequently, the conveyor belts G1–G4 are located offset relative to the depositing belts F1 to F4 by a distance corresponding to the pitch of the mould cavities.

The various drive means are timed with respect to one another in such a way that within each period of standstill of the tray conveyor drum the eccentric-connecting rod mechanism 0 performs a complete swinging movement, during which each press produces two lumps of clay. The lumps are successively ejected through the respective conveyor belts. From the mid position in FIG. 1 the movable frame K first moves to the left, towards a position vertically over the moulding cavities c, g, k and o within station I and the mould cavities a, e, i and m within station IV respectively, and then—after each of the moulding cavities just referred to have received a lump of clay—move to the right towards a position vertically over the moulding cavities d, h, l and p within station 1 and the mould cavities b, f, j and n within station IV respectively. Finally, after the last mentioned cavities have also been loaded with lumps of clay, back to the mid position, where the frame comes to a standstill. Thereafter, the conveyor drum performs a further displacement step in the direction y. It will be clear, that in this way a mould tray, which has received the first eight lumps of clay in station I will receive its second eight lumps of clay in station IV, which is three displacement steps later.

In the example shown and described hereinabove a drum is used as the conveying means for the stepwise displacement of the mould trays to be loaded. It will be understood, however, that the device according to this invention is also applicable where the mould trays are displaced from station I to station IV along a straight path.

I claim:

1. A clay molding apparatus comprising a stationary support, a frame swingably mounted to the support to pivot about a horizontal axis, drive means for swinging the frame about said axis, at least one clay supply device mounted to the frame above a mold tray conveyor, said supply device comprising an extruder, and a pair of conveyor belts having mutually facing, substantially vertical runs for receiving lumps of clay from the extruder and depositing said lumps in successive mold trays on said tray conveyor, wherein said axis is parallel to the direction of movement of the mold tray conveyor.

2. The apparatus according to claim 1, wherein said tray conveyor is journaled to move in an arc below said supply device, the axis of said arc being perpendicular to the horizontal axis about which said frame swings.

3. The apparatus according to claim 2, wherein said frame is swingable in a reciprocal movement about a mod-position and said clay supply device deposits lumps into respective ones of a plurality of juxtaposed mold cavities provided in each mold tray.

4. The apparatus according to claim 3, wherein said tray conveyor includes means for indexing said conveyor after each reciprocal swing of said frame to move said tray conveyor by a predetermined amount to present empty trays below said clay 5. The apparatus according to claim 2, wherein said mold tray conveyor includes a plurality of rows, each row extending parallel to the axis of the arc in which said tray conveyor moves and each row holding one of said mold trays, the apparatus further comprising a plurality of clay supply devices mounted to said frame and arranged in two rows parallel to the axis of the arc in which said tray conveyor moves, the clay supply devices in one of said two rows being offset from the clay supply devices in the other of said two rows so as to deposit lumps in alternate ones of a plurality of mold cavities provided in each of said mold trays.

6. The apparatus according to claim 5, wherein the distance of offset between the two rows of said clay supply devices corresponds to a multiple of the distance between adjacent rows of said mold trays.

* * * * *

UNITED STATES PATENT AND TRADEMARK OFFICE

CERTIFICATE OF CORRECTION

PATENT NO. : 5,131,831

DATED : July 21, 1992

INVENTOR(S) : Rudy Peeters

It is certified that error appears in the above-indentified patent and that said Letters Patent is hereby corrected as shown below:

On the title page, item [22] should read as follows:

--[22] PCT Filed: July 10, 1990 --; and insert after item [22], items [86] and [87] as follows:

[86] PCT No. PCT/NL90/00095

§371 Date: March 8, 1991
§102(e) Date: March 8, 1991

[87] PCT Pub. No.: WO 91/00794
PCT Pub. Date: January 24, 1991

Column 4, line 29, "mod-position" should be --mid-position--.

Column 4, line 36, after "clay" insert --supply device--.

Signed and Sealed this

Twenty-eighth Day of September, 1993

Bruce Lehman

*Attest:*

BRUCE LEHMAN

*Attesting Officer*

*Commissioner of Patents and Trademarks*